US008540472B2

(12) United States Patent
Huet et al.

(10) Patent No.: US 8,540,472 B2
(45) Date of Patent: Sep. 24, 2013

(54) BINDING MACHINE

(75) Inventors: Joel Huet, L'Aigle (FR); Didier Briere, L'Aigle (FR)

(73) Assignee: James Burn International, L'Aigle (FR)

( * ) Notice: Subject to any disclaimer, the term of this patent is extended or adjusted under 35 U.S.C. 154(b) by 272 days.

(21) Appl. No.: 12/935,975

(22) PCT Filed: Mar. 31, 2009

(86) PCT No.: PCT/EP2009/053808

§ 371 (c)(1),
(2), (4) Date: Dec. 21, 2010

(87) PCT Pub. No.: WO2009/121877

PCT Pub. Date: Oct. 8, 2009

(65) Prior Publication Data

US 2011/0110748 A1 May 12, 2011

(30) Foreign Application Priority Data

Apr. 3, 2008 (FR) ..... 08 52200

(51) Int. Cl.
*B42B 5/08* (2006.01)

(52) U.S. Cl.
USPC ..... 412/39; 412/7; 412/40

(58) Field of Classification Search
USPC ..... 412/6, 7, 38–40
See application file for complete search history.

(56) References Cited

U.S. PATENT DOCUMENTS

| | | | | |
|---|---|---|---|---|
| 4,482,279 | A * | 11/1984 | Jones et al. | 412/39 |
| 2003/0198536 | A1 | 10/2003 | Buhler et al. | |
| 2004/0120796 | A1 * | 6/2004 | Rieger et al. | 412/38 |

FOREIGN PATENT DOCUMENTS

| | | | |
|---|---|---|---|
| DE | 4424798 | A1 | 1/1995 |
| GB | 2148188 | A | 5/1985 |
| GB | 2291009 | A | 1/1996 |

* cited by examiner

*Primary Examiner* — Dana Ross
*Assistant Examiner* — Matthew G Katcoff
(74) *Attorney, Agent, or Firm* — Bachman & LaPointe, P.C.

(57) ABSTRACT

A machine for binding a packet of sheets of binding elements has a transfer belt designed to magnetically fix the binding elements and to move between a disengagement position in which it receives the binding elements and an engagement position in which it is positioned in a closure zone, closure devices disposed upstream of the transfer belt and designed, in the closure zone, to close the elements, a magnetic binding table disposed upstream of the closure devices, and comprising a fixing zone for holding a series of ends of the elements, and a magnetic top guide disposed upstream of the closure devices and above the binding table, and comprising a fixing zone for holding the other series of ends of the elements, the packet of perforated sheets being inserted between the table and the top guide.

18 Claims, 6 Drawing Sheets

BINDING MACHINE

BACKGROUND (1) Field of the Invention

The present invention concerns a machine for binding a packet of perforated sheets and a method of binding a packet of perforated sheets implemented in such a binding machine.

(2) Prior Art

In the field of machines for binding packets of perforated sheets, some of them use particular binding elements. FIG. 10 shows an example of these binding elements 206. These binding elements 206 are in the form of a metal wire curved so as to form a series of fingers curved in the form of a hairpin. Each binding element 206 has a closed end 604, also referred to as the "point", an open end 602, also referred to as the "base", and an intermediate zone 606 that is designed to deform when the said binding element 206 is closed. The perforated sheets are engaged on the points 604 and each finger is deformed in an annular form by approaching the point 604 close to the bases 602.

The binding machine bearing the reference Wir-O® Bind 3500 uses such binding elements 206. This binding machine comprises amongst other things:

- a station for supplying binding elements,
- a station for cutting the binding elements,
- a device for transferring the binding elements,
- a station for assembling the packet of perforated sheets on the binding elements,
- a station for closing the binding elements thus assembled with the packet of sheets, and
- a station for discharging the bound assembly.

The transfer device is in the form of a transfer belt forming a loop, which is magnetic so that the binding elements are fixed thereto. The transfer device receives cut binding elements at the discharge from the cutting station and transfers them successively through the assembly station, the closure station and the discharge station.

This binding machine has the disadvantage that assembling the sheets on the binding elements takes place manually, that is to say a technician must engage each point in the appropriate hole in the packet of sheets. This is because, since the points are not fixed, it is necessary, before closing the binding elements, to ensure that the packet of perforated sheets is correctly positioned.

In addition, this step is often lengthy, giving rise to a drop in the bound-assembly production rates.

SUMMARY OF THE INVENTION

One object of the present invention is to propose a binding machine that does not have the drawbacks of the prior art and which in particular affords better holding of the binding elements and an increase in the bound-assembly production rates.

To this end, there is proposed a machine for binding a packet of perforated sheets using metal binding elements formed by a series of curved fingers and comprising a first series of ends forming points, a second series of ends forming bases and intermediate zones connecting the first ends to the second ends, the binding machine comprising:

- a transfer belt mounted on a transfer assembly and designed to magnetically fix the binding elements at their intermediate zones, the transfer assembly comprising movement means designed for moving it between a disengagement position in which the transfer belt receives the binding elements and an engagement position in which the transfer belt is positioned in a closure zone,
- closure means disposed upstream of the transfer belt and designed, in the closure zone, to close the binding elements by crushing,
- a magnetic binding table disposed upstream of the closure means, the binding table comprising a fixing zone designed to magnetically hold one of the two series of ends, and
- a magnetic top guide disposed upstream of the closure means and above the binding table, the top guide comprising a fixing zone designed to magnetically hold the other series of ends, the packet of perforated sheets being inserted between the binding table and the top guide in the closure zone.

Advantageously, the binding machine comprises a plurality of stops disposed upstream of the transfer belt and downstream of the binding table and top guide.

Advantageously, each stop is able to move individually between an activation position in which it enters the closure zone and an idle position in which it is retracted out of the closure zone.

Advantageously, the means of moving the transfer assembly are designed to move the said transfer assembly horizontally.

Advantageously, the transfer belt comprises first means for generating a magnetic field, the binding table comprises second means for generating a magnetic field, the top guide comprises third means for generating a magnetic field, and, in the closure zone, the resulting magnetic field, generated by the second means and the third means on the binding elements, is greater than the magnetic field generated by the first means.

Advantageously, each of the means for generating a magnetic field is an array of magnets that runs along the transfer belt, the binding table and the top guide.

Advantageously, the array of magnets is disposed in the vicinity of the bottom part of the transfer belt.

Advantageously, the closure means comprise a bottom closure jaw disposed downstream of the binding table and a top closure jaw disposed above said bottom closure jaw.

Advantageously, the binding machine comprises adjustment means designed to vertically adjust the position of the bottom closure jaw.

Advantageously, the binding machine comprises adjustment means designed to vertically adjust the position of the top guide.

Advantageously, the fixing zone of the binding table and the fixing zone of the top guide comprise bevels.

The invention also proposes a method of binding a packet of perforated sheets by means of metal binding elements formed by a series of curved fingers and comprising a first series of ends forming points, a second series of ends forming bases and intermediate zones connecting the first ends to the second ends, the binding method being executed by a binding machine and comprising the steps of:

- supplying binding elements on a magnetic transfer belt disposed in a disengagement position,
- running the transfer belt with the said binding elements thus supplied so as to position them with respect to the positions of the perforations of the said sheets,
- moving the transfer belt to an engagement position in a closure zone,
- inserting the packet of perforated sheets in the closure zone between a magnetic binding table and a magnetic top guide, the binding table and the top guide being disposed upstream of the said transfer belt, moving the transfer belt to the disengagement position, closing the binding elements by closure means disposed upstream of the transfer belt and downstream of the binding table and the magnetic top guide, moving the whole of the transfer belt to the engagement position, running the transfer belt so as to eject the bound assembly from the binding machine, moving the transfer belt to the disengagement position, and looping back onto the step of supplying binding elements.

Advantageously, the binding element comprises, between the step of moving the transfer belt to the engagement position and the step of inserting the packet of perforated sheets, a step of moving a plurality of stops, disposed upstream of the transfer belt and downstream of the binding table and top guide, to an activation position in which the said stops enter the closure zone, in that it comprises, between the step of inserting the packet of perforated sheets and the step of closing the binding elements, a step of moving the said plurality of stops from the activation position to an idle position in which the stops are retracted out of the closure zone.

Advantageously, the steps of moving the transfer belt consist of horizontal translation steps.

Advantageously, the step of closing the binding elements consists of a step of crushing the said binding elements between a bottom closure jaw disposed downstream of the binding table and a top closure jaw disposed above the said bottom closure jaw, by vertical movement of the said top closure jaw.

Advantageously, the binding method comprises, prior to the step of supplying binding elements, a step of adjusting the vertical position of the bottom closure jaw.

Advantageously, the binding method comprises, prior to the step of supplying binding elements, a step of adjusting the vertical position of the top guide.

Advantageously, the binding method comprises, prior to the step of supplying binding elements, a step of adjusting the angular position of the transfer belt.

BRIEF DESCRIPTION OF THE DRAWINGS

The features of the invention mentioned above, as well as others, will emerge more clearly from a reading of the following description of an example embodiment, said description being given in relation to the accompanying drawings, among which.

DETAILED DESCRIPTION OF THE PREFERRED EMBODIMENT(S)

In the remainder of the description, the terms relating to a direction or to a position should be understood with respect to a binding machine in the operating position. In particular, the front of the binding machine is situated on the side where the packets of perforated sheets are inserted.

Figure 1:
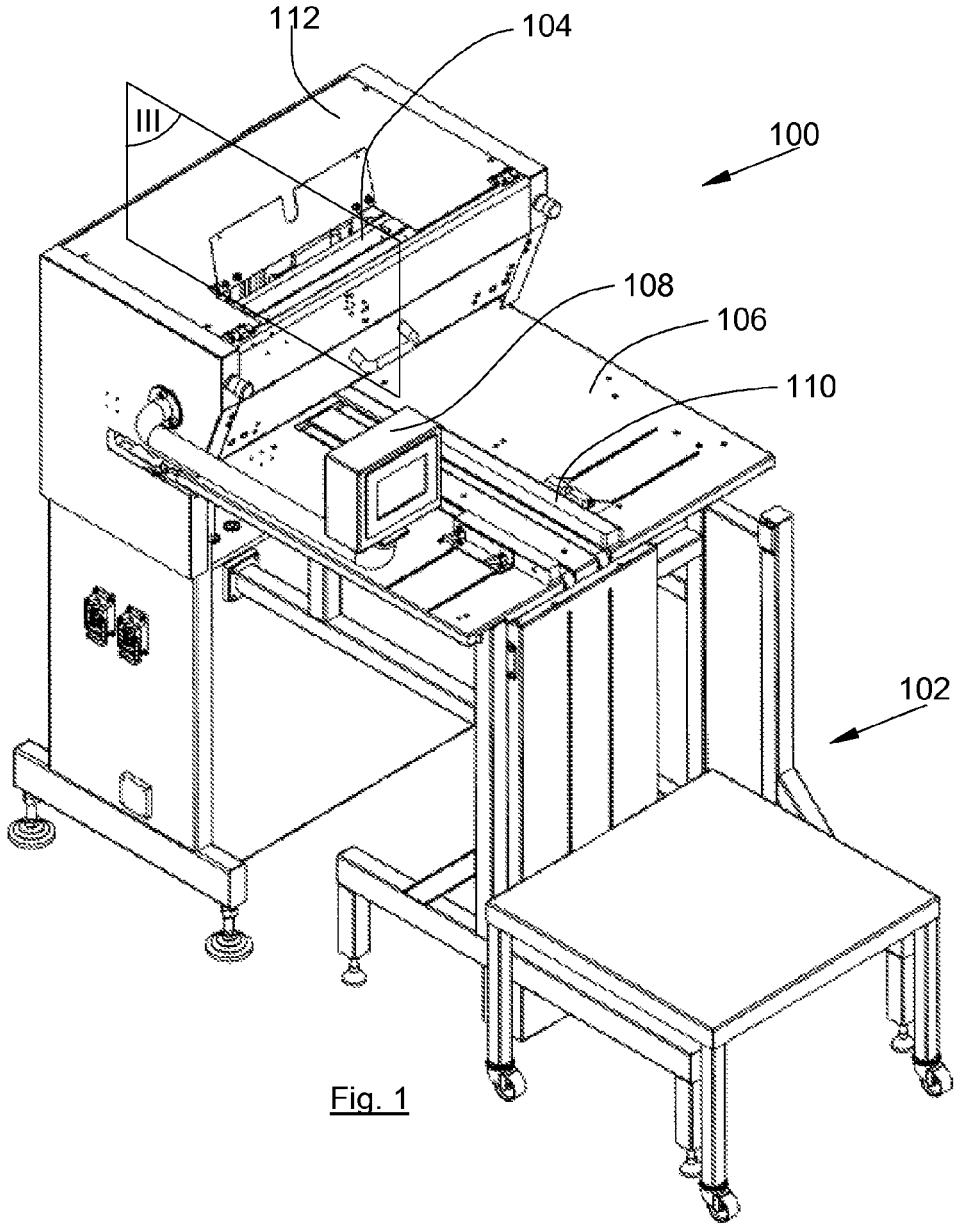
FIG. 1 is an overall view of a binding machine according to the invention.

FIG. 1 shows a binding machine 100 according to the invention. The binding machine 100 comprises a main module 112 in which a binding module 104 is disposed. In the embodiment of the invention presented, the binding machine 100 comprises an alignment table 106 on which alignment rules 110 are disposed. A packet of perforated sheets is presented on the alignment table 106 and is pushed inside the main module 112 and in particular inside the binding module 104 so that the latter inserts binding elements in the perforations in the sheets and closes the said binding elements so as to produce a bound assembly.

The binding machine 100 is controlled by a central unit that is programmable by means of an interface that here takes the form of a control panel 108.

The binding machine 100 can also comprise, upstream of the alignment table 106, an automatic supply station 102 designed to automatically supply the binding module 104 with packets of perforated sheets.

Figure 10:
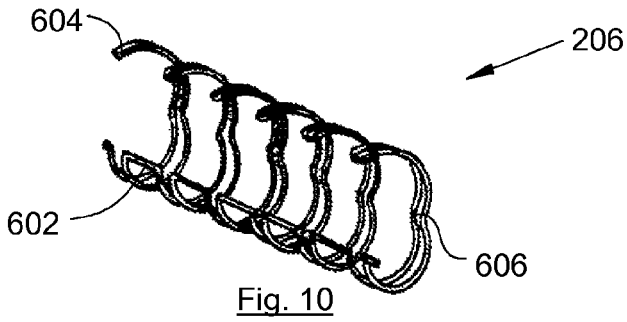
FIG. 10 shows the binding elements used in the binding machine according to the invention.

The binding machine 100 is particularly adapted to be used with binding elements 206, an example of which is shown in FIG. 10 and is in conformity with the binding elements that were described in the case of a binding machine of the prior art. The binding elements 206 are metal and formed by a series of curved fingers and comprising a first series of closed ends 604 forming "points", a second series of open ends 602 forming "bases", and intermediate zones 606 connecting the first ends 604 to the second ends 602.

The binding machine 100 preferably comprises a module supplying a binding element strip and a module for cutting the strip into binding elements 206. The binding elements 206 are in the form of a long strip, preferably packaged in the form of a reel. The strip is unwound at the supply station and enters the cutting station, where it is cut into a series of binding elements 206. The length of each series of binding elements 206 is determined according to the dimensions of the packet of perforated sheets to be bound. According to the type of packet of perforated sheets to be bound, it is possible that a single series of binding elements 206 may be sufficient, but it is also possible that several series may be necessary.

Figure 2:
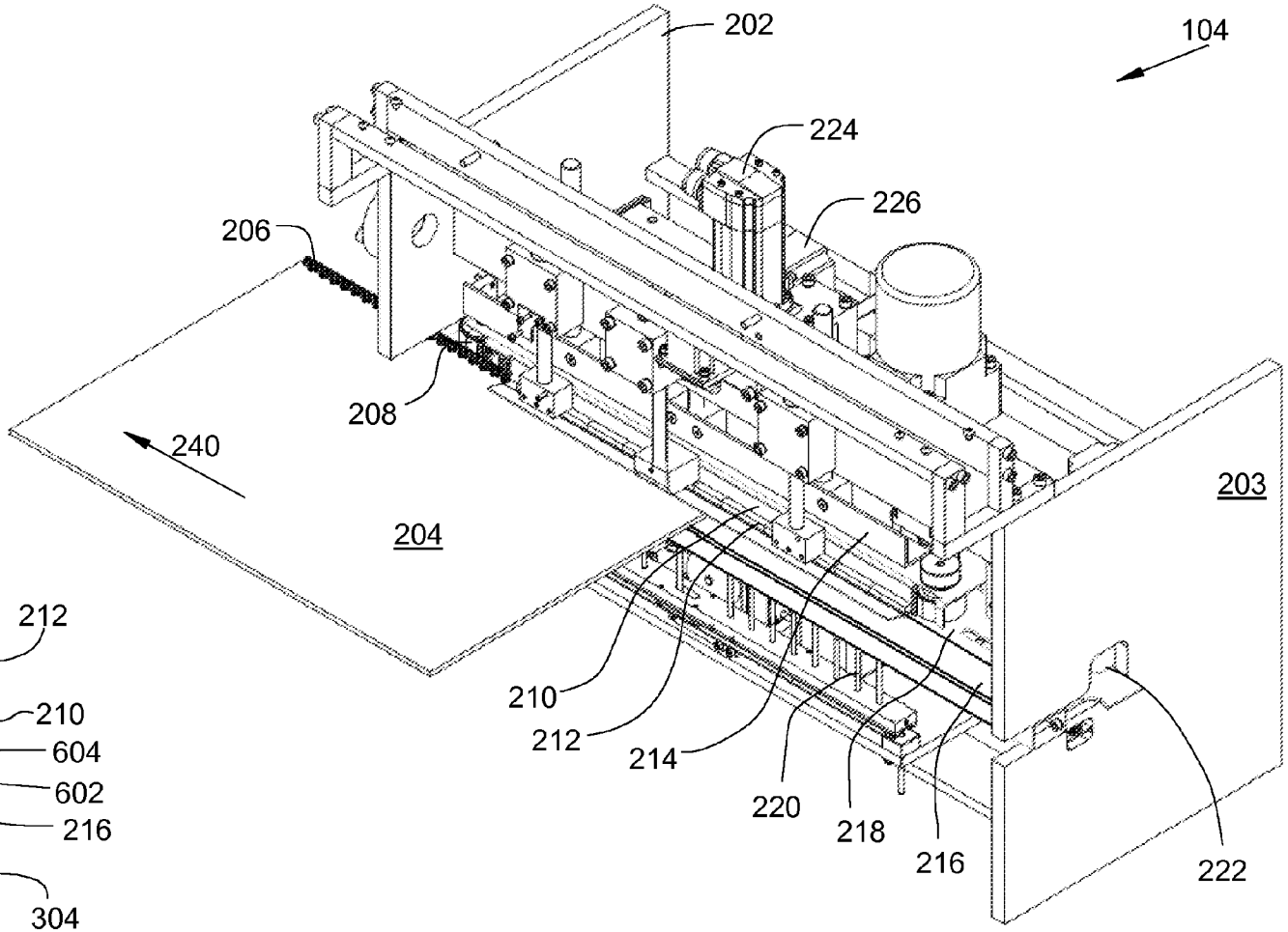
FIG. 2 is a view of the binding module of the binding machine of FIG. 1.

FIG. 2 shows the binding module 104 that has been isolated from the binding machine 100.

The binding machine 104 comprises a frame consisting here of two parallel plates 202 and 203 on which the various elements constituting the binding module 104 are fixed.

In the embodiment of the invention presented in FIG. 2, the plate 203 has a passage 222 through which the binding elements 206 coming from the cutting module are brought. Each series of binding elements 206 is presented at the passage 222 in the position shown in FIG. 10. That is to say the points 604 are disposed at the top with respect to the bases 602, which are disposed at the bottom, and the opening between the points 604 and the bases 604 is oriented towards the front of the binding machine 100.

The binding elements 206 are received at the exit from the passage 222 by a transfer assembly comprising a transfer belt 208. The transfer assembly comprises movement means that make it movable between a disengagement position and an engagement position. In the engagement position, the transfer belt 208 is disposed in a closure zone in order to position the binding elements 206. In the disengagement position, the transfer belt 208 is disposed so as to receive the binding elements 206 at the exit from the passage 222 and to be disengaged from the closure zone. The belt 208 takes the form of a closed loop that is driven in a horizontal plane by two wheels with a vertical axis. The transfer belt 208 thus comprises two rectilinear sections and two curved sections. The transfer belt 208 is designed to magnetically fix the binding elements 206 at their intermediate zones 606.

In a preferred embodiment, the means of moving the transfer assembly are designed to move the said transfer assembly, and therefore the transfer belt 208, in translation in a horizontal plane.

The closure zone is disposed at the front of the binding module and upstream of the transfer belt 208, at closure means that consist here of a bottom closure jaw 218 and a top closure jaw 214 disposed above the bottom closure jaw 218. Bringing the top closure jaw 214 close to the bottom closure jaw 218 causes the crushing of the binding elements 206, which close in an annular shape by bringing the points 604 close to the bases 602.

Upstream of the closure zone and therefore of the closure means, there is disposed a guidance assembly designed to guide the packet of perforated sheets 204 when it is inserted in the binding module 104. The guidance assembly comprises a binding table 216 on which there rests the packet of perforated sheets 204 and a top guide 210 disposed above the binding table 216. The packet of perforated sheets 204 is inserted between the binding table 216 and the top guide 210.

As explained below, the binding table 216 and the top guide 210 each have a fixing zone, one of the fixing zones being designed to hold one of the series of ends of the binding elements 206 and the other fixing zone being designed to hold the other series of ends of the binding elements 206.

Each fixing zone is magnetised. For this purpose, in the embodiment of the invention presented here, the binding table 216 and the top guide 210 carry an array of magnets 212.

Fitting a magnetised top guide 210 and binding table 216 makes it possible to hold the binding elements 206 whatever the diameter thereof. The binding elements 206 being thus held, the binding elements 206 can then be closed easily and rapidly since there is no risk of the binding elements 206 and in particular the ends thereof moving during the placing of the packet of perforated sheets 204 and the closure thereof. It is therefore not necessary to introduce the points 604 into the perforations, this introduction taking place automatically when the binding elements 206 are crushed.

Holding the bases 602 and the points 604 by the top guide 210 and the binding table 216 also makes it possible to have a single top closure jaw 214, whatever the diameter of the binding elements 206. This is because the jaws 218 and 214 play no role in the holding of the binding elements 206 and it is therefore not necessary to adapt their forms to those of the binding elements 206.

The positioning of the packet of perforated sheets 204 with respect to depth in the binding module 104, that is to say the distance of advancement thereof inside the closure zone, is adjusted, in the embodiment of the invention presented in the figures, by a stop assembly 220, each stop 220 being disposed upstream of the transfer belt 208 and downstream of the binding table 216 and of the top guide 210. Each stop 220 takes here the form of a vertical needle that is able to move vertically between an idle position and an activation position. In the activation position, the stops 220 enter the closure zone and serve as a stop for the packet of perforated sheets 204 when it is introduced so that it is correctly positioned with respect to the binding elements 206. In the idle position, the stops 220 are retracted and are therefore not present in the closure zone. According to the type of packet of perforated sheets 204 to be bound and the binding elements 206 used, it is possible that only some stops 220 may be necessary. For this purpose, each stop 220 is able to move individually and can therefore be actuated independently of the other stops 220. For example, each stop 220 is actuated by an independent pneumatic actuator and each actuator is activated by the central unit that manages the various electronic components of the binding machine 100. For example, it is possible to deactivate the central stops 220 where a hook of the calender hook type is provided.

As explained below, the top closure jaw 214 is able to move vertically and, for this purpose, actuation means, here a motor 224, are provided to raise and lower the top closure jaw 214 through appropriate kinematics.

In the same way, the bottom closure jaw 218 is able to move vertically and, for this purpose, the binding machine 100 comprises adjustment means designed to vertically adjust the position of the bottom closure jaw 218. Here the adjustment means consist of a motor 226 and appropriate kinematics.

Figure 3:
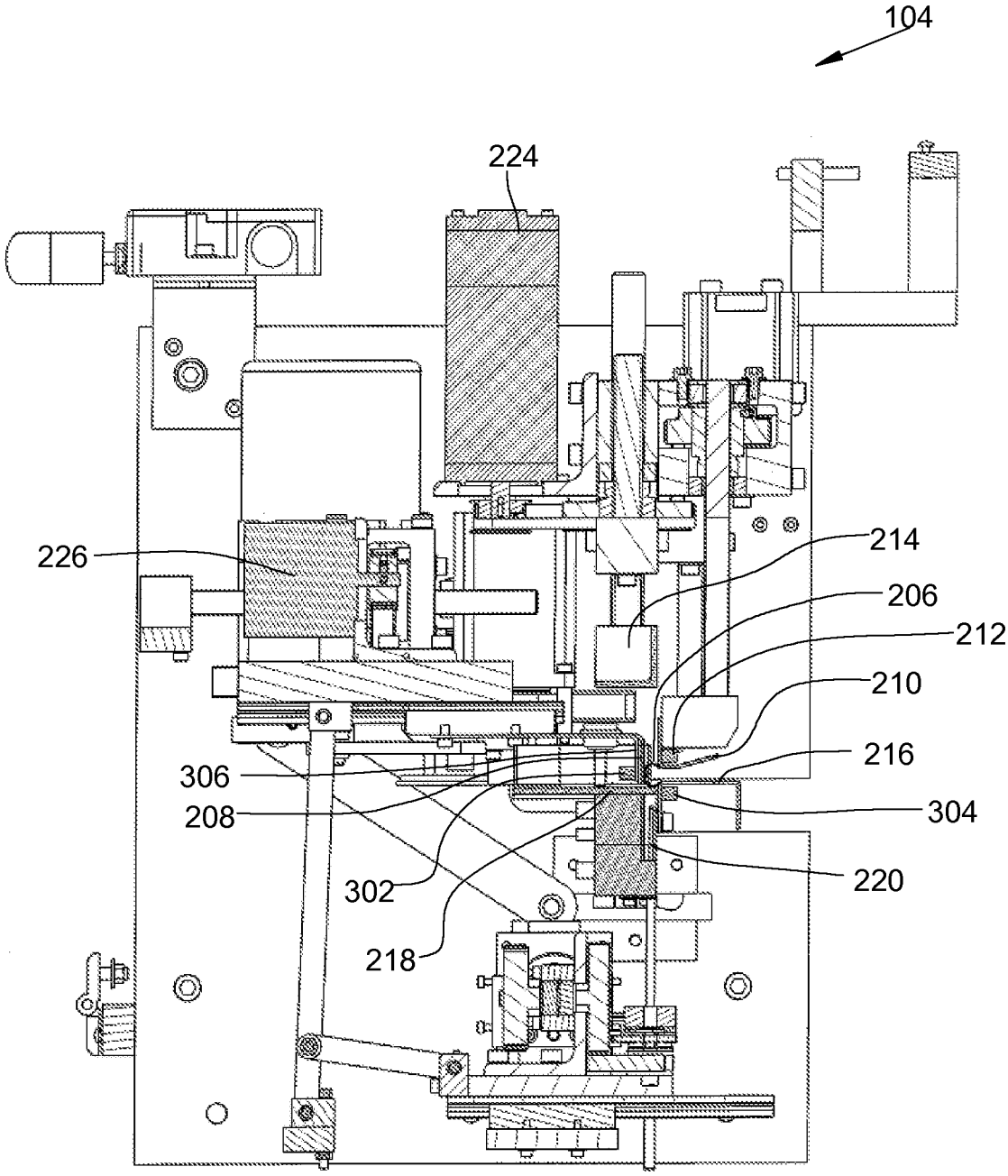
FIG. 3 is a section along the line in FIG. 1, of the binding module.

FIG. 3 shows a section of the binding module 104 through a vertical plane.

The binding table 216 and the top guide 210 are preferably produced from metal plates inside which arrays of magnets are disposed, referenced respectively 212 and 304.

In the same way, the transfer belt 208 slides in front of a metal wall 306, which is made magnetic by the fitting of an array of magnets 302 at the rear of the said metal wall 306.

Each array of magnets 212, 304, 302 runs over the length of the metal plate 210, 216, 306 that carries it, that is to say perpendicular to the direction of introduction of the packet of perforated sheets 204.

FIGS. 4 to 9 show enlargements of the closure zone and steps that are implemented to bind the packet of perforated sheets 204.

Figure 4:
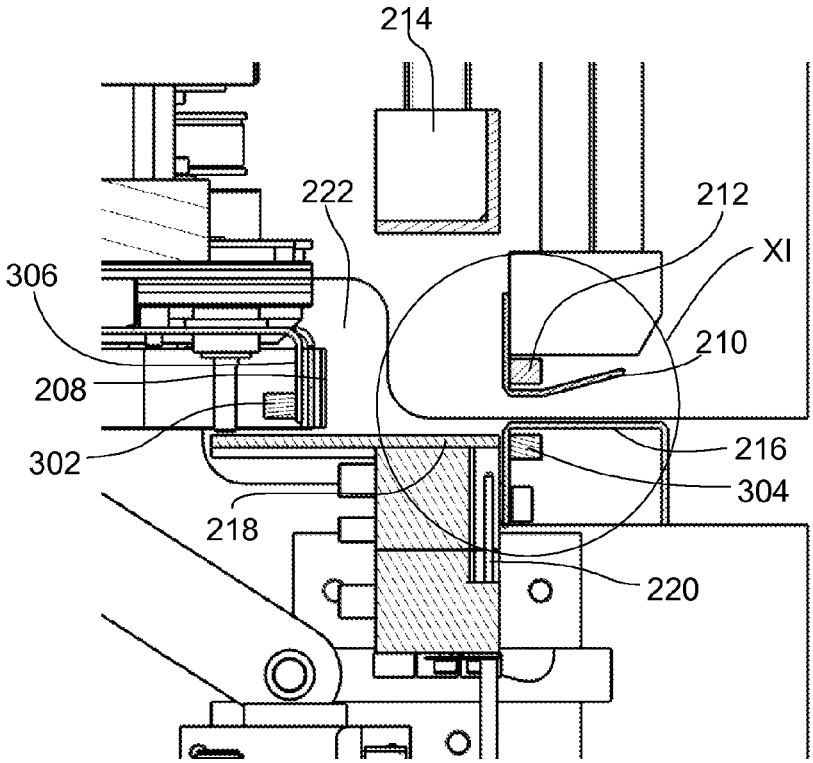
FIGS. 4 to 9 show the various steps for obtaining a bound assembly.

In FIG. 4, the transfer assembly is in the disengagement position, that is to say the transfer belt 208 is withdrawn from the closure zone. The transfer assembly moves towards the rear of the binding machine 100. The transfer belt 208 is positioned facing the passage 222 so as to be able to receive the binding elements 206 that emerge from the said passage 222. The transfer belt 208 receives, at the exit from the passage 222, at the same time that it is driven by the wheels, the binding elements 206 that are fixed to the transfer belt 208 by reaction to the magnetic field created by the array of magnets 302. The transfer belt 208 is driven by the wheels as long as is necessary to bring the binding elements 206 facing the positions that they are to occupy in order to be able to be inserted subsequently in the perforations in the sheets of the packet 204 to be bound.

In order to hold the binding elements 206, the transfer belt 208 comprises vertical ribs distant from one another. The distance between the ribs is such that a rib comes to be inserted in a free space between two successive points 604. The positions of the ribs are such that all types of binding element 206 can thus be held.

So that the transfer belt 208 can hold the binding elements 206 of all diameters, the array of magnets 302 is disposed in the vicinity of the bottom part of the transfer belt 208. Thus the positioning of the binding elements 206 is governed by the position of the array of magnets 302 and by the bottom closure jaw 218 on which the binding elements 206 rest.

Figure 5:
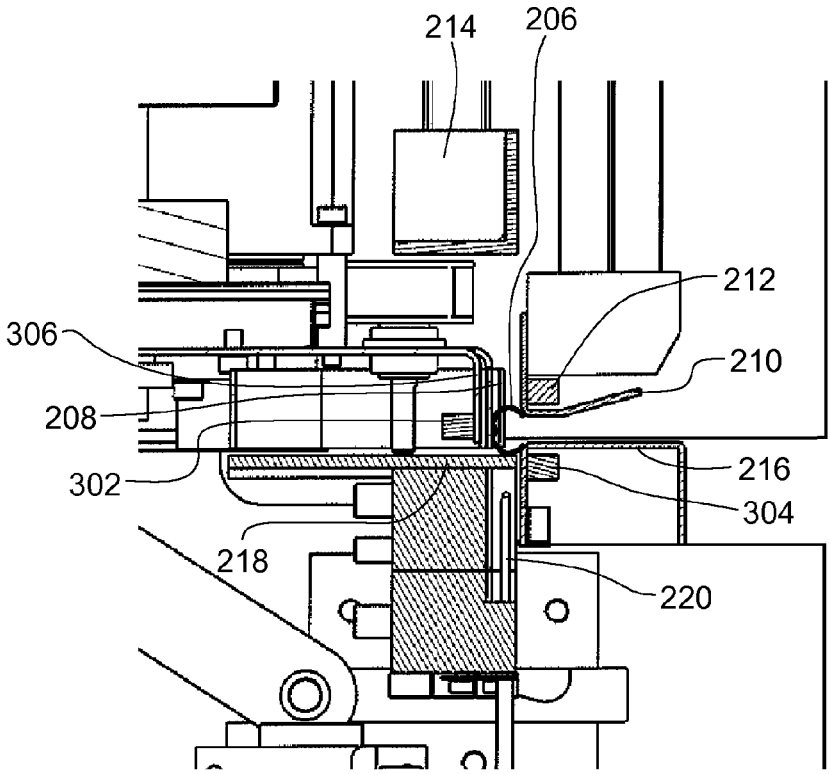

In FIG. 5, the transfer assembly is in the engagement position, that is to say the rectilinear section of the transfer belt 208 that carries the binding elements 206 is engaged in the closure zone. The transfer assembly has thus moved horizontally in a direction perpendicular to the rectilinear part of the transfer belt 208. The binding elements 206 then occupy the appropriate positions for being able to be inserted subsequently in the perforations in the sheets of the packet 204 to be bound.

The stops 220 are in the idle position, that is to say they are retracted so as not to enter the closure zone and not to interfere with the progression of the binding elements 206 when they move towards the engagement position.

The bottom closure jaw 218 here consists of a horizontal plate and is disposed in the vicinity of the transfer belt 208, so that the binding elements 206 that are held by the transfer belt 208 rest on the bottom closure jaw 218 by means of rounded areas carrying the bases 602. The bottom closure jaw 218 is positioned so that the ends of the binding elements 206 that carry the bases 602 are positioned slightly below the plane of the binding table 216, thus preventing, when the packet of perforated sheets 204 is positioned, interaction between the edge of the packet 204 and the said ends.

Figure 6:
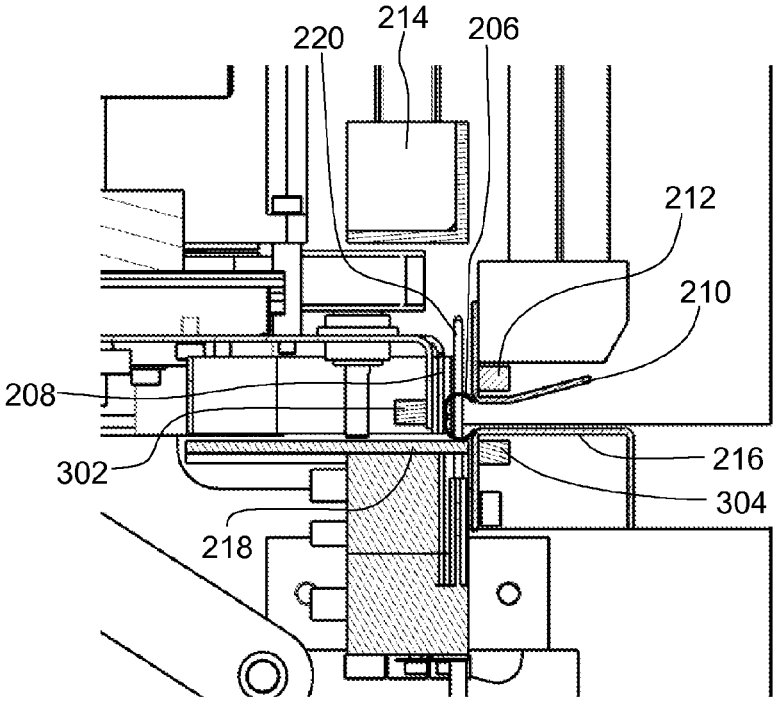

In FIG. 6, the transfer assembly is still in the engagement position but the transfer belt 208 is immobile in the closure zone. The stops 220 are in the activation position, that is to say they pass through the closure zone.

The position of the stops 220 is adapted so that, on passing to the activation position, they do not strike the binding elements 206 but pass through them in the areas between the fingers.

Figure 7:
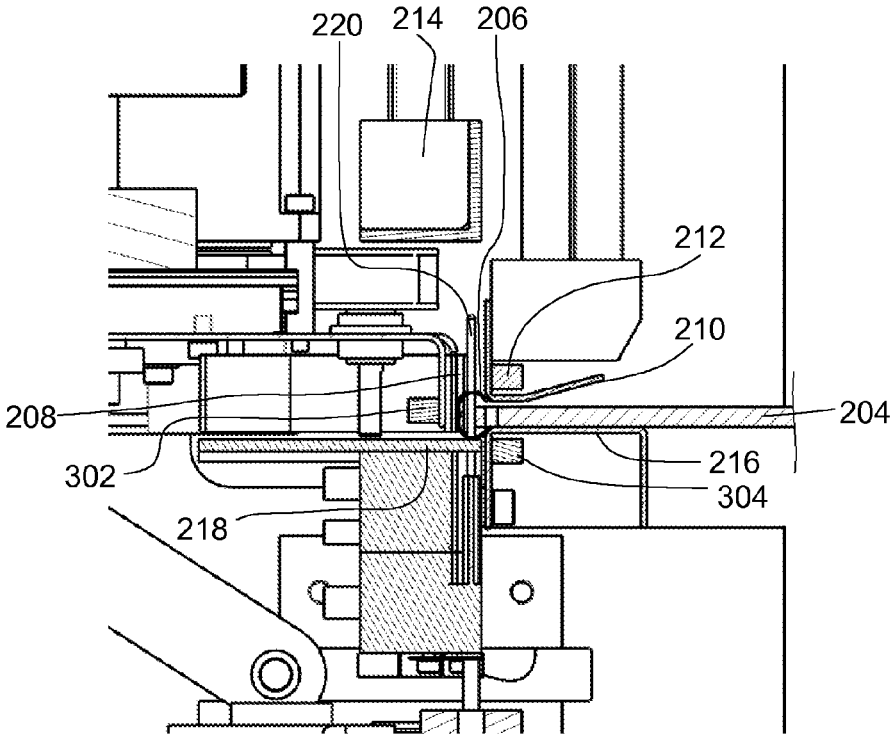

In FIG. 7, the packet of perforated sheets 204 is introduced between the binding table 216 and the top guide 210. The edge of the packet 204 that is perforated is brought against the stops 220. The placing of the packet of perforated sheets 204 is guided by the alignment rules 110 against which they slide, and by the binding table 216 on which it bears.

Figure 8:
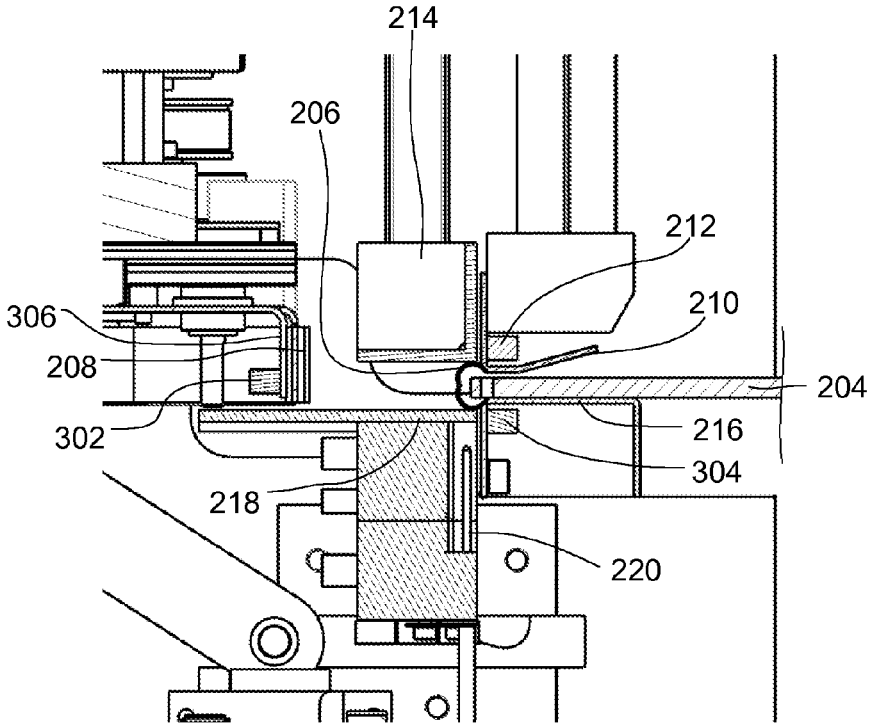

In FIG. 8, the transfer assembly is brought into the disengagement position. At the same time, the stops 220 are retracted and fall into the idle position. Despite the withdrawal of the transfer assembly the binding elements 206 are held in position by the array of magnets 212 of the top guide 210 and the array of magnets 304 of the binding table 216. These two arrays of magnets 210 and 212 are such that they create, on the binding elements 206, a magnetic attraction force greater than the magnetic attraction force created by the array of magnets 302 of the transfer belt 208.

In general terms, the transfer belt 208 comprises first means 302 for generating a magnetic field, the binding table 216 comprises second means 304 for generating a magnetic field and the top guide 210 comprises third means 212 for generating a magnetic field. In the closure zone, the resulting magnetic field generated by the second means 304 and the third means 212 on the binding elements 206 is greater than the magnetic field generated by the first means 302.

After the withdrawals of the transfer belt 208 and the stops 220, the top closure jaw 214 is lowered so as to come into contact with the binding elements 206 and in particular with the rounded areas carrying the points 604. The lowering of the top closure jaw 214 is effected by a vertical downward movement. The top closure jaw 214 then continues its descent so as to close the binding elements 206 by crushing them and giving them an annular shape by moving the points 604 close to the bases 602.

Figure 9:
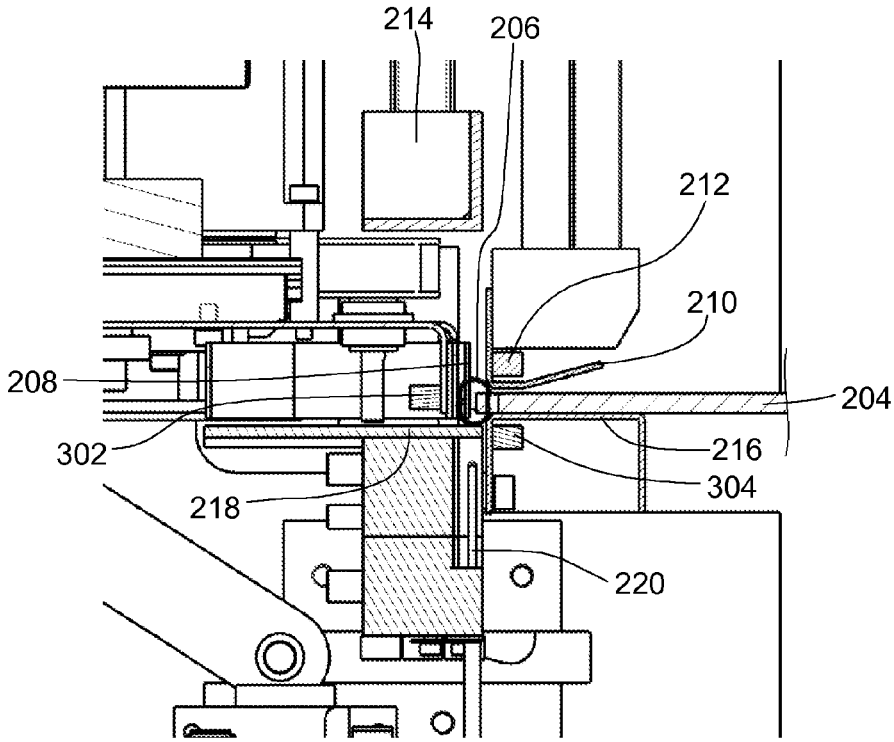

In FIG. 9, the top closure jaw 214 has been raised to leave the closure zone, and then the transfer assembly has been placed in the engagement position by bringing the transfer belt 208 so as to mesh with the binding elements 206. The transfer belt 208 is then driven and the rectilinear part that meshes with the binding elements 206 moves towards the side opposite to the cutting module, that is to say in the direction of the arrow 240 in FIG. 2. When a binding element 206 comes level with the wheel that drives the transfer belt 208, it becomes disconnected from the said belt 208 and thus the bound assembly is ejected from the binding module 104 towards a subsequent processing station. During this movement, the top guide 210 and the binding table 216 constitute guides for the binding elements 206, thus preventing the bound assembly going aslant and jamming.

After this ejection, the transfer assembly returns to its disengagement position and a new cycle recommences with FIG. 4.

Figure 11:
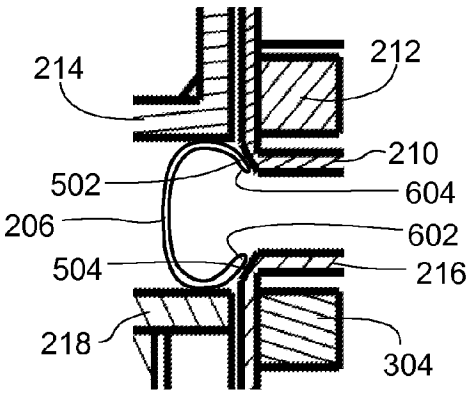
FIG. 11 is an enlargement of the detail XI in FIG. 4.

FIG. 11 shows an enlargement of the closure zone with the binding elements 206. As already explained above, the bottom closure jaw 218 is positioned so that the ends of the binding elements 206 that carry the bases 602 are positioned slightly below the plane of the binding table 216. In the same way, the top guide 210 is positioned so that the ends of the binding elements 206 that carry the points 604 are positioned slightly above the top guide 210.

For this purpose, the binding machine comprises adjustment means designed to vertically adjust the position of the top guide 210.

The fixing zone of the top guide 210 and the fixing zone of the binding table 216, at which the ends of the binding elements 206 are fixed, each have a bevel 502, 504 of substantially 45° over 1.5 mm. These bevels 502 and 504 make it possible to orient the ends of the binding elements 206 when they are closed by the top closure jaw 214, which makes it possible to obtain an annular shape, the profile of which is practically circular. The bevels 502 and 504 prevent, when the binding elements 206 are closed, the ends 206 and 604 of the latter from abutting against the vertical flanks of the top guide 210 and the binding table 216 and twist without closing.

By means of the control table 108, a technician can program the binding machine 100, which can then function automatically.

A binding method used in a binding machine 100 according to the invention comprises:

- a step of supplying cut binding elements 206 from the cutting module and through the passage 222 to the binding module 104 and more particularly on the transfer belt 208,
- a step of running the transfer belt 208 with the said binding elements 206 thus supplied so as to position them with respect to the positions of the perforations in the sheets that will subsequently be inserted.
- a step of moving the transfer assembly and therefore the transfer belt 208 to the engagement position in the closure zone,
- a step of inserting the packet of perforated sheets 204 in the closure zone, between the binding table 216 and the top guide 210,
- a step of moving the transfer assembly and therefore the transfer belt 208 to a disengagement position outside the closure zone,
- a step of closing the binding elements 206 by the closure means 214, 218 by crushing in order to close them and produce the bound assembly,
- a step of moving the transfer assembly and therefore the transfer belt 208 to the engagement position in the closure zone,
- a step of running the transfer belt 208 so as to reject the bound assembly from the binding module 104 to the subsequent processing station,
- a step of moving the transfer assembly and therefore the transfer belt 208 to the disengagement position outside the closure zone, and
- a step of looping back onto the step of supplying binding elements 206.

When stops 220 equip the binding machine 100, the binding method comprises, between the step of moving the transfer belt 208 to the engagement position and the step of inserting the packet of perforated sheets 204, a step of moving the selected stops 220 to the activation position and, between the step of inserting the packet of perforated sheets 204 and the step of closing the binding elements 206, a step of moving the stops 220 from the activation position to the idle position.

The packet of perforated sheets 204 then comes into abutment against the stops 220. The stops 220 pass from the idle position to the activation position by means of a vertical movement.

In the embodiment of the invention presented here, the steps of moving the transfer belt 208 consist of horizontal translation steps.

Where the closure elements consist of the bottom closure jaw 218 and the top closure jaw 214, the step of closing the binding elements 206 consists of a step of crushing the binding elements 206 between the said jaws 214 and 218 by vertical movement of the top closure jaw 214.

This crushing step is followed by a step of raising the top closure jaw 214 out of the closure zone prior to the implementation of the step of moving the transfer belt 208 to the following disengagement position.

The step of lowering the top closure jaw 214 is preferably triggered by the technician in order to ensure that it is not triggered when the packet of perforated sheets 204 is correctly positioned.

The binding method also comprises an initialisation phase that is performed prior to the first step of supplying binding elements 206. The technician enters, for example, the diameter, the number and the distribution of the binding elements 206 and the central unit demands the implantation of the initialisation phase during which the various components of the binding machine 100 are adjusted according to these characteristics.

The initialisation phase comprises amongst other things:

- a step of adjusting the vertical position of the bottom closure jaw 218 according to the diameter of the binding elements 206 by actuation of the motor 226, in order to guarantee the vertical distance between the plane of the binding table 216 and the plane of the bottom closure jaw 218,
- a step of adjusting and storing the engagement position of the transfer assembly and more particularly of the transfer belt 208 in order to be used subsequently during the binding process,
- a step of adjusting the angular position of the transfer belt 208 in order to position the vertical ribs according to the binding elements 206 used,
- a step of adjusting and storing the vertical position that the top closure jaw 214 must have when it closes the binding elements 206,
- a step of adjusting the vertical position of the top guide 210 and consequently of the array of magnets 212 according to the diameter of the binding elements 206 by actuation of an actuator, and
- a step of evaluating and storing the number and choice of the stops 220 to be activated.

Adjustment of the binding machine 100 is therefore automatic and does not require the intervention of the technician on the binding machine 100, which gives rise to a saving in time during use and great ease of use.

The step of inserting the packet of perforated sheets 204 is preferably performed by the technician, who is guided along the alignment rules 110 that were manually adjusted in advance, during the initialisation phase.

However, these two steps can also be automated by installing the automatic feed station 102.

In the same way, the adjustment of the alignment rules 110 can be performed automatically during the initialisation phase.

Naturally the present invention is not limited to the examples and embodiments described and shown but is capable of numerous variants accessible to persons skilled in the art.

For example, it is possible to provide that, instead of moving the bottom closure jaw vertically, it is the binding table that moves vertically.

The invention claimed is:

1. Machine for binding a packet of perforated sheets using metal binding elements formed by a series of curved fingers and comprising a first series of ends forming points, a second series of ends forming bases, and intermediate zones connecting the first ends to the second ends, the binding machine comprising:

- a transfer belt mounted on a transfer assembly and designed to magnetically fix the binding elements at the intermediate zones, the transfer assembly comprising movement means designed for moving said transfer belt between a disengagement position in which the transfer belt is not positioned in a closure zone and receives the binding elements and an engagement position in which the transfer belt is positioned in the closure zone,
- closure means disposed upstream of the transfer belt and designed, in the closure zone, to close the binding elements by crushing when the transfer belt is in the disengagement position,
- a magnetic binding table disposed upstream of the closure means, the magnetic binding table comprising a fixing zone designed to magnetically hold a first one of the two series of ends, and
- a magnetic top guide disposed upstream of the closure means and above the magnetic binding table, the magnetic top guide comprising a fixing zone designed to magnetically hold a second one of the two series of ends, the packet of perforated sheets being inserted between the magnetic binding table and the magnetic top guide in the closure zone.

2. Binding machine according to claim 1, further comprising a plurality of stops disposed upstream of the transfer belt and downstream of the magnetic binding table and the magnetic top guide.

3. Binding machine according to claim 2, wherein each said stop is able to move individually between an activation position in which said stop enters the closure zone and an idle position in which said stop is retracted outside the closure zone.

4. Binding machine according to claim 1, wherein the movement means of the transfer assembly are designed to move said transfer belt horizontally.

5. Binding machine according to claim 1, wherein the transfer belt comprises first means for generating a magnetic field, the magnetic binding table comprises second means for generating a magnetic field, the magnetic top guide comprises third means for generating a magnetic field, and, in the closure zone, a resulting magnetic field generated by the second means and the third means on the binding elements is greater than the magnetic field generated by the first means.

6. Binding machine according to claim 5, wherein each of the means for generating a magnetic field is an array of magnets that runs along the transfer belt, the magnetic binding table and the magnetic top guide.

7. Binding machine according to claim 6, wherein the array of magnets is disposed in the vicinity of a bottom part of the transfer belt.

8. Binding machine according to claim 1, wherein the closure means comprise a bottom closure jaw disposed downstream of the magnetic binding table and a top closure jaw disposed above said bottom closure jaw.

9. Binding machine according to claim 8, further comprising adjustment means for vertically adjusting the position of the bottom closure jaw.

10. Binding machine according to claim 1, further comprising adjustment means for vertically adjusting the position of the magnetic top guide.

11. Binding machine according to claim 1, wherein the fixing zone of the magnetic binding table and the fixing zone of the magnetic top guide comprise bevels.

12. Method of binding a packet of perforated sheets by means of metal binding elements formed by a series of curved fingers and comprising a first series of ends forming points, a second series of ends forming bases, and intermediate zones connecting the first ends to the second ends, the binding method being executed by a binding machine and comprising the steps of:

supplying binding elements on a magnetic transfer belt disposed in a disengagement position, running the magnetic transfer belt with the binding elements thus supplied so as to position the binding elements with respect to positions of perforations of the sheets, moving the magnetic transfer belt to an engagement position in a closure zone, inserting the packet of perforated sheets in the closure zone between a magnetic binding table and a magnetic top guide, with the magnetic binding table and the magnetic top guide being disposed upstream of the magnetic transfer belt, moving the magnetic transfer belt to the disengagement position, closing the binding elements by closure means disposed upstream of the magnetic transfer belt and downstream of the magnetic binding table and the magnetic top guide, moving the whole of the magnetic transfer belt to the engagement position, running the magnetic transfer belt so as to eject the bound assembly from the binding machine, moving the magnetic transfer belt to the disengagement position, and looping back onto the step of supplying binding elements.

13. Binding method according to claim 12, wherein, between the step of moving the magnetic transfer belt to the engagement position and the step of inserting the packet of perforated sheets, a step of moving a plurality of stops, disposed upstream of the magnetic transfer belt and downstream of the magnetic binding table and magnetic top guide, to an activation position in which the stops enter the closure zone, and between the step of inserting the packet of perforated sheets and the step of closing the binding elements, a step of moving the said plurality of stops from the activation position to an idle position in which the stops are retracted out of the closure zone.

14. Binding method according to claim 12, wherein the step of moving the magnetic transfer belt consists of horizontal translation steps.

15. Binding method according to claim 12, wherein the step of closing the binding elements consists of a step of crushing the said binding elements between a bottom closure jaw disposed downstream of the magnetic binding table and a top closure jaw disposed above the said bottom closure jaw, by vertical movement of the top closure jaw.

16. Binding method according to claim 15, further comprising prior to the step of supplying binding elements, a step of adjusting the vertical position of the bottom closure jaw.

17. Binding method according to claim 12, further comprising prior to the step of supplying binding elements, a step of adjusting a vertical position of the magnetic top guide.

18. Binding method according to claim 12, further comprising prior to the step of supplying binding elements, a step of adjusting an angular position of the magnetic transfer belt.

* * * * *